US006538627B1

(12) United States Patent
Whang et al.

(10) Patent No.: US 6,538,627 B1
(45) Date of Patent: Mar. 25, 2003

(54) ENERGY RECOVERY DRIVER CIRCUIT FOR AC PLASMA DISPLAY PANEL

(75) Inventors: Ki Woong Whang, School of Electrical Engineering, College of Engineering, Seoul National University, Seoul 151-742 (KR); Jin Ho Yang, Seoul (KR)

(73) Assignee: Ki Woong Whang, Seoul (KR)

( * ) Notice: Subject to any disclaimer, the term of this patent is extended or adjusted under 35 U.S.C. 154(b) by 0 days.

(21) Appl. No.: 09/223,108

(22) Filed: Dec. 30, 1998

(30) Foreign Application Priority Data

Dec. 31, 1997 (KR) ..... 97-81975

(51) Int. Cl.[7] ..... G09G 3/28

(52) U.S. Cl. ..... 345/60; 345/55; 345/61; 345/58; 345/63; 345/66; 345/67; 345/68; 345/69; 345/204; 315/169.1; 315/169.3; 315/169.4

(58) Field of Search ..... 345/60, 68, 213, 345/204, 58, 63, 66, 55, 61, 67, 69; 315/169.1, 169.3, 169.4

(56) References Cited

U.S. PATENT DOCUMENTS

| | | | | |
|---|---|---|---|---|
| 4,866,349 A | | 9/1989 | Weber et al. | 315/169.4 |
| 5,081,400 A | | 1/1992 | Weber et al. | 315/169.4 |
| 5,438,290 A | | 8/1995 | Tanaka | 327/108 |
| 5,642,018 A | | 6/1997 | Marcotte | 315/169.4 |
| 5,654,728 A | * | 8/1997 | Kanazawa et al. | 345/68 |
| 5,670,974 A | | 9/1997 | Ohba et al. | 345/60 |
| 5,717,437 A | | 2/1998 | Sano et al. | 345/211 |
| 5,786,794 A | | 7/1998 | Kishi et al. | 345/60 |
| 5,943,030 A | * | 8/1999 | Minamibayashi | 345/60 |
| 5,952,986 A | * | 9/1999 | Nguyen et al. | 345/68 |
| 6,028,573 A | * | 2/2000 | Orita et al. | 345/66 |
| 6,034,655 A | * | 3/2000 | You | 345/60 |
| 6,054,970 A | * | 4/2000 | Hirakawa et al. | 345/60 |
| 6,072,447 A | * | 4/2000 | Noborio | 345/60 |
| 6,011,355 A | * | 6/2000 | Nagai | 345/60 |
| 6,088,010 A | * | 7/2000 | Makino et al. | 345/60 |
| 6,160,531 A | * | 12/2000 | Chen et al. | 345/60 |

* cited by examiner

*Primary Examiner*—Richard Hjerpe
*Assistant Examiner*—Ali Zamani
(74) *Attorney, Agent, or Firm*—Dilworth & Barrese LLP

(57) ABSTRACT

The present invention provides an energy recovery driver circuit for the AC plasma display panel having an enhanced energy recovery efficiency with a short voltage rise and fall period. The energy recovery driver circuit comprises an energy recovery part interposed between the sustain driver circuits for the X1 and X2 electrodes and the other energy recovery part interposed between the sustain driver circuits for Y1 and Y2 electrodes, wherein X1 and Y1 electrodes are respectively defined as electrodes of a first and a second type of electrodes employed in the first AC-PDP cell group, and X2 and Y2 electrodes are respectively defined as electrodes of the first and the second type of electrodes employed in the second AC-PDP cell group. Thus the energy recovery circuit of the present invention utilizes the effect of reducing the load capacitance to a half of its original value, when two (2) loads are serially connected.

6 Claims, 10 Drawing Sheets

ENERGY RECOVERY DRIVER CIRCUIT FOR AC PLASMA DISPLAY PANEL

BACKGROUND OF THE INVENTION

1. Field of the Invention

The present invention relates to an energy recovery driver circuit for alternating current plasma display panel (hereinafter "AC-PDP"), and more particularly to an energy recovery driver circuit for the AC-PDP with a high energy recovery efficiency and an excellent property of enabling shorter rise-fall period of the voltage applied to the electrodes.

2. Description of the Prior Art

An AC-PDP is a graphic display panel of a new concept, utilizing plasma produced by gas discharge. An AC-PDP generally comprises a pair of 3 mm thick glass substrates formed with appropriate electrodes, coated with a fluorescent material and provided with a 0.1~0.2 mm space therebetween for producing plasma. Accordingly, an AC-PDP may form a bigger panel compared to LCD or FED, but due to the high driving voltage requirement and complicated input wave-forms, large power consumption and high costs are inevitable.

There are various driving methods of AC-PDPs according to the manner in which the driving pulses applied unto the pixels, i.e., addressing pulse, writing pulse, sustain pulse and erase pulse, are combined.

To realize color gray scales, a large number of sustain pulses are required, and the more the sustain pulses are provided, the better brightness the pixels will have. For example, to display 60 frames utilizing 256 gray scales per second with a unit level of four sustain pulses, 61,440 sustain pulses have to be applied unto the pixels and this predominates the total AC-PDP power consumption.

The sustain pulses are produced by two types of electrodes, one type of which produces voltages higher than the other type does and the voltage level difference is determined within the range of 140V to 200V.

Whenever these sustain pulses are applied unto each individual cell of the AC-PDP, displacement current corresponding to reactive power will flow. The moment the added amount of the wall voltage and the external voltage exceed the discharge threshold voltage, a discharge current will flow, thereby producing plasma discharge.

Sustain discharge is initiated only when certain condition inside a cell are satisfied. But, even when the conditions are not sufficient to produce plasma within a cell, the displacement current is to be constantly introduced into the individual cells, while the discharge current would not flow. The amount of displacement current is determined by the characteristic capacitance (Cp) inherent in a pixel which will be dependent on its structure and material. Reactive power consumed by the characteristic capacitance predominates the total power consumption.

Accordingly, extensive researches have been conducted to reduce the reactive power consumption and the circuit employed for such a task is called a energy recovery driver circuit.

Two types of electrodes are employed in each set of cells, facing each other wherebetween sustain discharge is performed by applying high voltages. If one type of the electrodes are defined as X, the X electrodes of the first set of the cells may be defined as X1 and the second set as X2. Similarly, if the other type of electrodes are defined as Y, the Y electrodes of the first set of the cells may be defined as Y1 and the other set as Y2. The conventional Weber method requires a separate energy recovery driver circuit corresponding to the energy recovery portion for each of the X1, X2, Y1 and Y2 electrodes.

FIG. 1 is a schematic diagram of an energy recovery driver circuit utilizing the conventional Weber method. FIG. 3 is a schematic diagram of an example of the Weber method energy recovery driver circuit wherein a tri-electrode planar discharge type AC-PDP is divided into two blocks to be driven separately.

The Weber type energy recovery driver circuit shown in FIG. 1 is operated as follows: Initial state is that all the switches of the side 1 sustain driver are open and the switch SW4 of the side 2 sustain driver is closed. And, the voltage level of each electrode is 0V. When the switch SW1 of the side 1 sustain driver is closed, electric charges stored in the capacitor Css, with the boost from the inductor L, flows into the PDP electrodes, thereby raising their voltage level. When the voltage level reaches its peak, the switch SW3 is closed and an increment of the voltage Vs is added to the PDP electrode voltage. Accordingly, a sustain discharge occurs in the AC-PDP and a discharge current flows through the AC-PDP into the switch SW4 of the side 2 sustain driver 2. Then the switch SW1 is open and the switch SW3 is open, too.

When the switch SW2 is closed at this state, electric charges present at the PDP electrodes move towards the capacitor Css through the inductor L and the switch SW2. When the PDP electrode voltages reach their minimum, the switch SW4 is closed, thereby dropping the PDP electrode voltages to 0V.

The Weber method explained above, however, requires independent inductors, many switches and diodes for the respective driver circuits and this creates much complexity in structure. Moreover, to enhance the energy recovery efficiency, longer time period for voltage rise and fall is required, thereby making it difficult to accomplish a short period of time for voltage rise and fall and at the same time a high energy recovery efficiency.

FIG. 2 is a schematic diagram of an energy recovery driver circuit utilizing the conventional Sakai method. The Sakai method is for an energy recovery method of utilizing exchange of voltages applied at two electrode groups wherein sustain discharge is produced by the manipulation of the switches SW1~SW6. In this circuit, energy recovery circuits are respectively arranged between two sustain driver circuits for X1 and Y1 electrodes and also X2 and Y2 electrodes.

However, the Sakai type energy recovery circuits also have the disadvantage of decrease in the energy recovery efficiency for shorter rise and fall period of applied voltage. These voltage rise and fall characteristics are similar to those of the Weber method and the energy recovery efficiency may differ only a little according to the circuit characteristics.

SUMMARY OF THE INVENTION

One object of the present invention is to provide an energy recovery driver circuit for the AC-PDP having an enhanced energy recovery efficiency with a short voltage rise and fall period by solving the above mentioned problems.

The energy recovery driver circuit for the AC-PDP according to the present invention, for the purpose of driving a pair of the AC-PDP cell groups, provides an energy recovery driver circuit which comprises an energy recovery part interposed between the sustain driver circuits for the X1 and X2 electrodes and the other energy recovery part interposed between the sustain driver circuits for Y1 and Y2 electrodes, wherein X1 and Y1 electrodes are respectively defined as electrodes of a first and a second type of electrodes employed in the first AC-PDP cell group, and X2 and Y2 electrodes are respectively defined as electrodes of the first and the second type of electrodes employed in the second AC-PDP cell group. Thus the energy recovery circuit of the present invention utilizes the effect of reducing the load capacitance to a half of its original value, when two (2) loads are serially connected.

DETAILED DESCRIPTION OF THE PREFERRED EMBODIMENTS

A detailed description of the present invention will be provided below with reference to the accompanying drawings.

Figure 4:
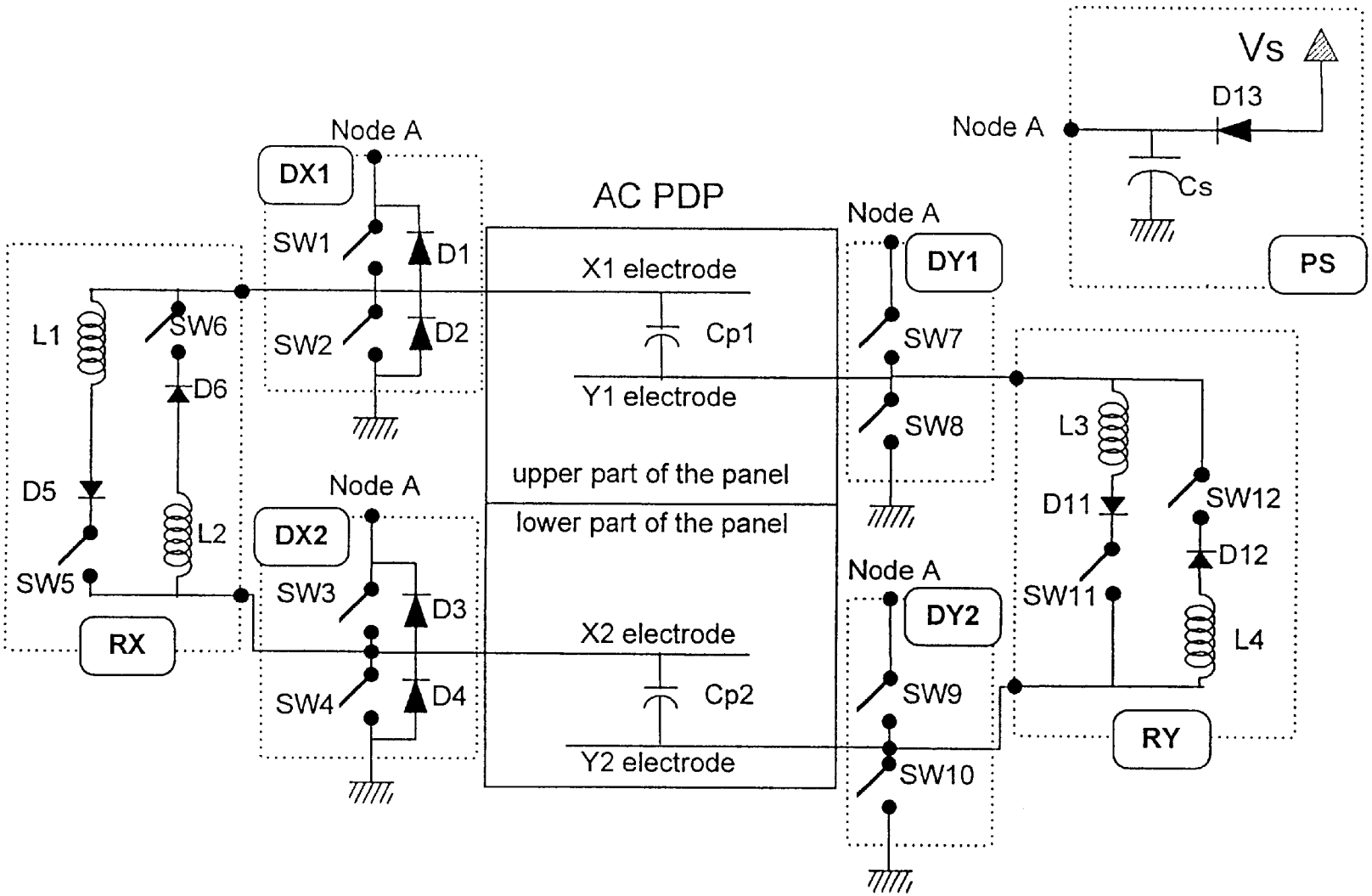
FIG. 4 is a schematic diagram of an energy recovery driver circuit according to the present invention.

FIG. 4 is a schematic diagram of an energy recovery driver circuit according to the present invention.

Referring to FIG. 4, there are a multitude of electrodes having the roles of driving the relevant cells (a cell here means a subpixel, three or more of which form a pixel for realizing the full colors), which are grouped to X electrodes and Y electrodes. The cells are divided into the even numbers of groups with the same number of the cells and the sustain discharge is generated in the individual group of cells by means of the independent switch elements. Accordingly, only the cells having the required conditions among those belonging to the same group starts the sustain discharge, through the same switch elements, making the currents flow through those switch elements.

When X electrodes in a group of cells is defined as the X1 electrodes and Y electrodes in the same group is defined as the Y1 electrodes, X electrodes in another group neighboring to the X1 electrodes is defined as the X2 electrodes and Y electrodes in the same group neighboring to the Y1 electrodes is defined as the Y2 electrodes. In order to start the sustain discharge, it is required to alternate the voltage difference in an X electrode and Y electrode set and for this purpose, the sustain driver part for the X electrode must generate the displacement current to flow to the X electrode so as to change the voltage level of the X electrode, due to the capacitance between the X electrode and other electrode (s) (the Y electrode plus the address electrode in case of the tri-electrode type). For the same reason, the sustain driver part for the Y electrode must make the displacement current flow to the Y electrode so as to change the voltage level of the Y electrode.

As those displacement currents are charged in the capacitors arranged between the electrodes and thus may be reused. In order to reuse the displacement currents, an energy recovery circuit part is provided between the two sustain driver parts for the above mentioned X1 and X2 electrodes and the other one between the two sustain driver parts for the Y1 and Y2 electrodes.

In FIG. 4, the sustain driver parts DX1, DX2, DY1 and DY2 of an AC-PDP apply discharge currents into the first group of cells and the second group of cells through four independent pairs of switches SW1 and SW2, SW3 and SW4, SW7 and SW8, SW9 and SW10, which flow through the first and second groups of cells so as to produce different and/or same electric potential between the X and Y electrodes, thereby supplying discharge current that may start sustain discharges within the individual pixels. The AC-PDP according to an embodiment of the present invention further comprises two energy recovery parts RX and RY respectively arranged between the sustain driver parts DX1 and DX2, DY1 and DY2, the energy recovery parts RX and RY each having a pair of inductors L1 and L2, L3 and L4, a pair of diodes D5 and D6, D11 and D12 and a pair of switches SW5 and SW6, SW11 and SW12 respectively, wherein the energy recovery parts RX and RY are employed for exchanging electric charges between the two groups of cells. The energy recovery parts are not limited to those as shown in FIG. 4.

In short, the energy recovery parts RX and RY are respectively arranged between the sustain driver parts DX1 and DX2, and DY1 and DY2, which are connected to the X1, X2, Y1 and Y2 electrodes respectively.

More specifically, the external connecting portions of RX are connected to the interior of the sustain driver parts DX1 and DX2, and the external connecting portions of RY are connected to the interior of the sustain driver parts DY1 and DY2.

Though the external connecting portions of the energy recovery parts are connected with the interior of the sustain driver parts, they are connected, after all, to the X1 or X2 or Y1 or Y2 electrodes.

Figure 5:
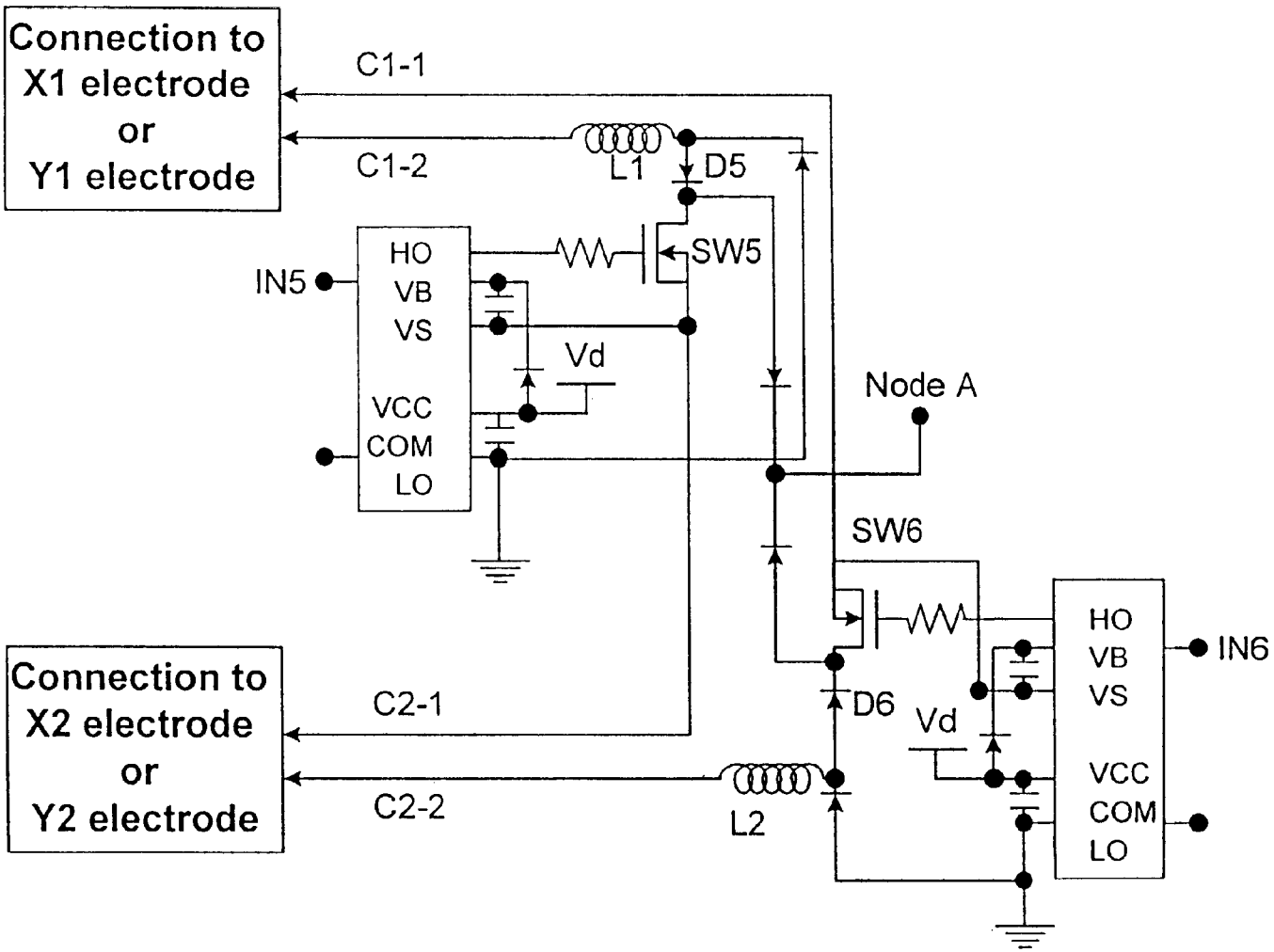
FIG. 5 is a circuit diagram showing an embodiment of power recovery parts for an energy recovery driver circuit according to the present invention.

FIG. 5 is a detailed circuit diagram representing an embodiment of the energy recovery parts RX and RY according to the present invention.

As shown in FIG. 5, current can flow from the energy recovery parts RX or RY to the sustain driver parts DX or DY through the connecting portions of C1-1, C2-1 and similarly from the sustain driver parts DX or DY to the energy recovery parts RX or RY through the connecting portions of C1-2, C2-2.

The power supply part PS, as shown in FIG. 4, comprises a diode D13 located between a voltage supply Vs and a large capacity capacitance Cs, thereby blocking the inverse current from flowing through the node A.

Figure 6A:
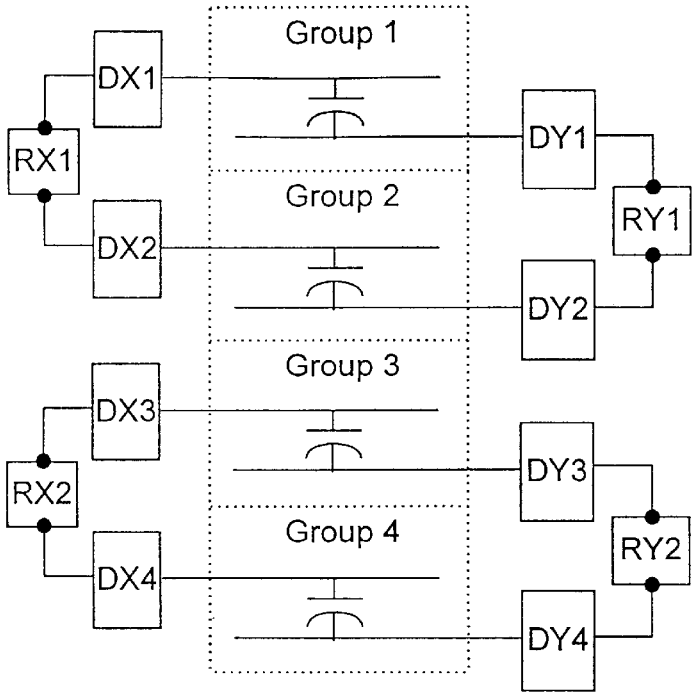
FIGS. 6*a* and 6*b* are diagrams showing examples of the expanded construction of the energy recovery driver circuits according to the present invention.
Figure 6B:
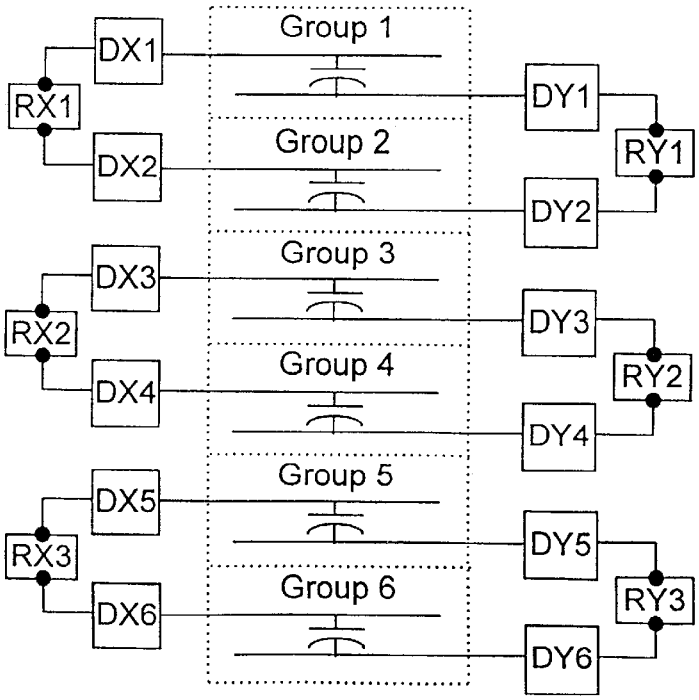

When several groups of the energy recovery driver circuits as shown in FIG. 4 are required due to the enlarged size of the AC-PDP, the AC-PDP may be divided into the four, six or more blocks, two of which may have a pair of the energy recovery driver circuit respectively as shown in FIGS. 6*a* and 6*b*.

Figure 7:
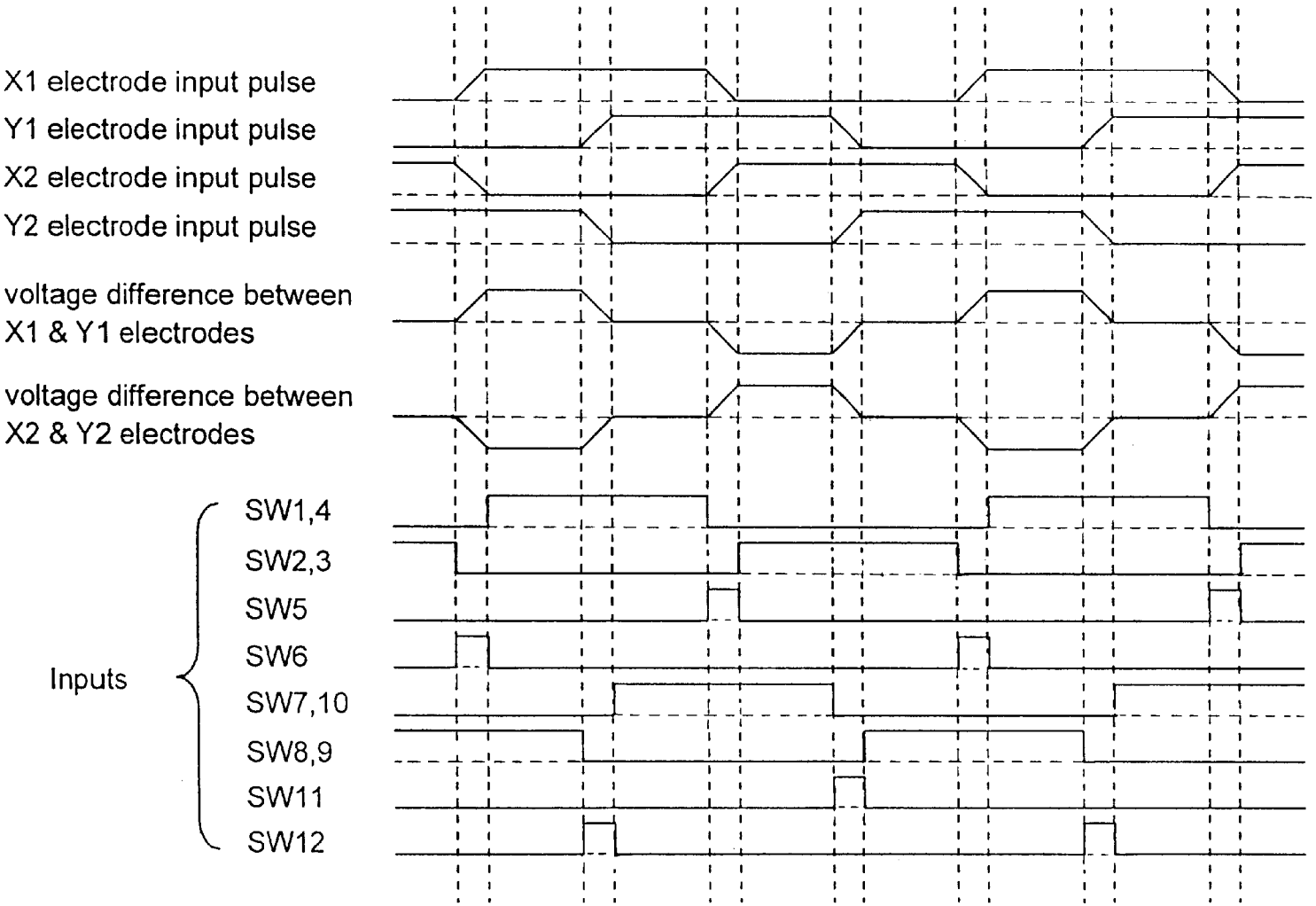
FIG. 7 is a timing diagram for explaining the operation of an energy recovery driver circuit according to the present invention.

FIG. 7 is a timing diagram for explaining the operation of an energy recovery driver circuit according to the present invention. As shown, the initial values of the X1 and Y1 electrode voltage levels are set to 0 volt and the initial values of the X2 and Y2 electrode voltage levels are set to discharge sustain voltage levels.

The power consumption here does not mean the real consumption of that moment, but means the consumption in view of the power supply. In other words, the current flow in and out through the power supply part is multiplied by the voltage, and the capacitance Cs and the diode D13 make the power supply part not to be equivalent to a resistor in some states.

During the time period when the X1 electrodes voltage level rises and the X2 electrodes voltage level falls and if within this period the switches SW1~SW5, SW7 and SW10~SW12 are kept opened and the switches SW8 and SW9 are kept closed, closing of the switch SW6 will create a current flow to the electrodes X1 due to the electric potential difference between the X2 and X1 electrodes, thereby initiating a voltage variation. The current in the inductor L2 reaches its maximum, when the voltages at the X1 and X2 electrodes become identical, but after the voltage at the X1 electrodes exceeds that at the X2 electrodes, movement of electric charges due to the inherent characteristics of the inductor L2 for keeping the current flowed therethrough makes the voltage at the X1 electrodes rise almost to Vs. This causes a change in the voltage levels present at both terminals of the capacitors Cp1 and Cp2, thereby causing a current equivalent to the quantity of the electric charges, flowing into the X1 electrodes to maintain the voltages at the Y1 and Y2 electrodes, to flow through the switch SW9. This means a large power consumption if we let this charges flow to the ground GND after all.

When the X1 electrode voltage level reaches its peak and the current flowing through the inductor L2 becomes 0 A, the current flows in the opposite direction and at that moment the voltage across the diode D6 becomes reversed and no current can flow through the diode D6. Therefore, the voltages at the X1 and X2 electrodes are maintained at their last states (at the X1 electrodes close to Vs and at the X2 electrode close to 0V), because those electric charges moved from the X2 electrodes to the X1 electrodes remain as they are.

In this state, as shown in FIG. 7, the voltage levels of the electrodes are Vs for X1, 0V for Y1, 0V for X2, and Vs for Y2. When the switches SW1 and SW4 are closed, the AC-PDP cells which have the required conditions will start the sustain discharge. The discharge current flows out through the switches SW1 and SW8 and further to the switches S9 and SW4.

After the sustain discharge is over, the voltage rise at the Y1 electrodes and the voltage fall at the Y2 electrodes will take place. At the initial state when the switches SW2, SW3, SW5, SW6, and SW7~SW11 are opened and the switches SW1 and SW4 are closed, the closing of the switch SW12 causes a current flow into the Y1 electrodes due to the electric potential difference between the Y2 and Y1 electrodes, thereby initiating a voltage variation.

The current on the inductor L4 reaches its peak, when the voltage levels at the Y1 and Y2 electrodes become identical, but the inherent characteristics of the inductor L4 keeping the current flowed therethrough makes the voltage at the Y1 electrode rise almost to Vs. This causes a change in the voltage levels at both terminals of the capacitors Cp1 and Cp2, thereby causing electrical charges flowing to the Y1 electrode to maintain the voltage levels at the X1 and X2 electrodes to be charged in the capacitor Cs of the power supply part and the currents as much as the electrical charges lost through the Y2 electrodes are supplemented from the ground through the diode D4. Since a similar amount of charges consumed in the rise of the voltage level at the X1 electrodes and in the fall of the voltage level at the X2 electrodes are recharged in the power supply part, almost no loss of the power arises, while the energy recovery is performed.

When the Y1 electrode voltage level reaches its peak and the current in the inductor L4 becomes 0 A, the current flow is inverted and the voltage across the diode D12 becomes reversed, thereby making the diode D12 reverse-biased and blocking the flow of the inverted current. Therefore, the last state at the Y1 and Y2 electrodes (voltage level at Y1 close to Vs, and at Y2 close to 0V) can be maintained since the electric charges moved from the Y2 electrodes to the Y1 electrodes have to remain there.

Thereafter, the switches SW7 and SW10 are closed to adjust the voltage levels at the Y1 and Y2 electrodes to Vs and 0V respectively.

This state does not render the occurrence of discharge possible, since the voltage across the electrodes X1 and Y1 are the same and also the voltage across X2 and Y2 are the same.

In this state, the voltage levels at the X1, Y1, X2 and Y2 electrodes are Vs, Vs, 0V and 0V respectively. Thereafter, the voltage level of the X1 electrodes starts to fall and that of the X2 electrodes starts to rise.

The above operation is performed in the same way as when the voltage level of the X1 electrodes rises and the voltage level of the X2 electrodes falls. More specifically, the operation timing diagram of the switch SW6 applies to the switch SW5 and that of the diode D6 applies to the diode D5 as represented in FIG. 7. The operation in this time period consumes the energy, too.

Thereafter, when the switches SW2 and SW3 are closed, the voltage levels of the electrodes X1, Y1, X2 and Y2 become 0V, Vs, Vs, and 0V respectively. This renders possible the cells of the AC-PDP which are under the relevant discharge condition to start the sustain discharge. The discharge current produced at this time period flows from the switch SW7 through the switches SW2 and SW3 to the switch SW10.

After this time period, the voltage level of the Y1 electrodes falls and the voltage level of the Y2 electrodes rises.

The above operation is performed in the same way as when the voltage level of the Y1 electrodes rises and the voltage level of the Y2 electrodes falls. More specifically, the operation timing diagram of the switch SW12 applies to the switch SW11 and that of the diode D12 applies to the diode D11 as represented in FIG. 7.

The operation in this time period is also a charging operation, and thus does not consume the energy.

Thereafter, the voltage level of the electrodes X1, Y1, X2 and Y2 change to 0V, 0V, Vs and Vs respectively and this state is identical to the initial state.

Accordingly, the required number of the sustain discharges are performed, as the above are repeated.

Figure 8:
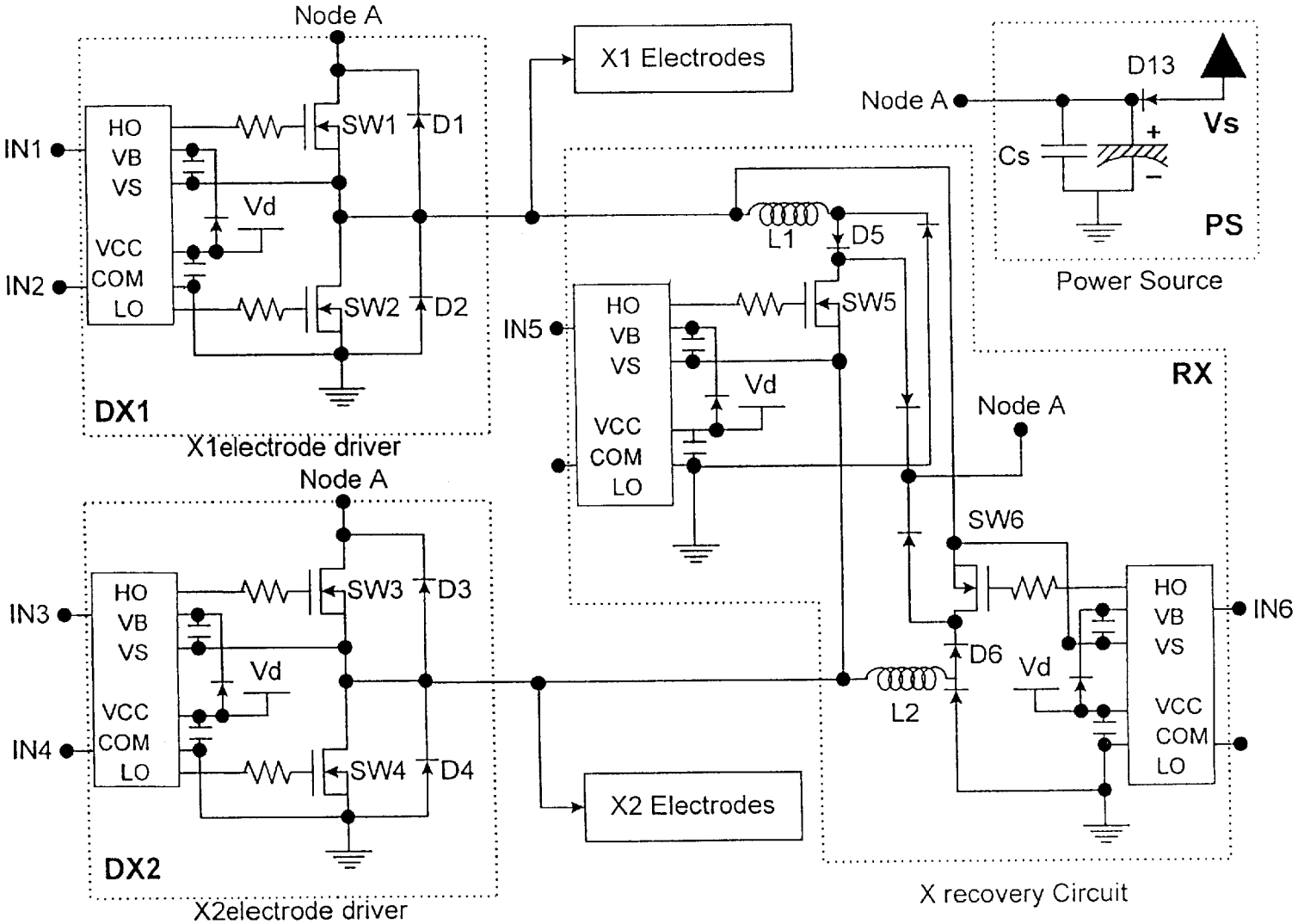
FIG. 8 is a circuit diagram of an energy recovery part for an energy recovery driver circuit according to the present invention.

FIG. 8 shows an example of the X electrode energy recovery part according to the present invention.

For the switches SW1~SW6, n-type MOSFETS, for example, IRF640 of International Rectifier, may be used and IR2110L of the same company may be used as the gate drivers for the n-type MOSFETs.

The diodes D5 and D6 are desirable to have a shorter reverse recovery time and SBYV27-200 diode of the General Semiconductor Co. may be an example.

For the inductors L1 and L2, a toroidal type is preferred and the inductor cores of the toroidal type should have a smaller core loss within the frequency range of 100 KHz to 10 MHz. T106-2 of Micrometals may be an example. Due to their low inductance and high frequency range, air core type inductors may be utilized.

Figure 9:
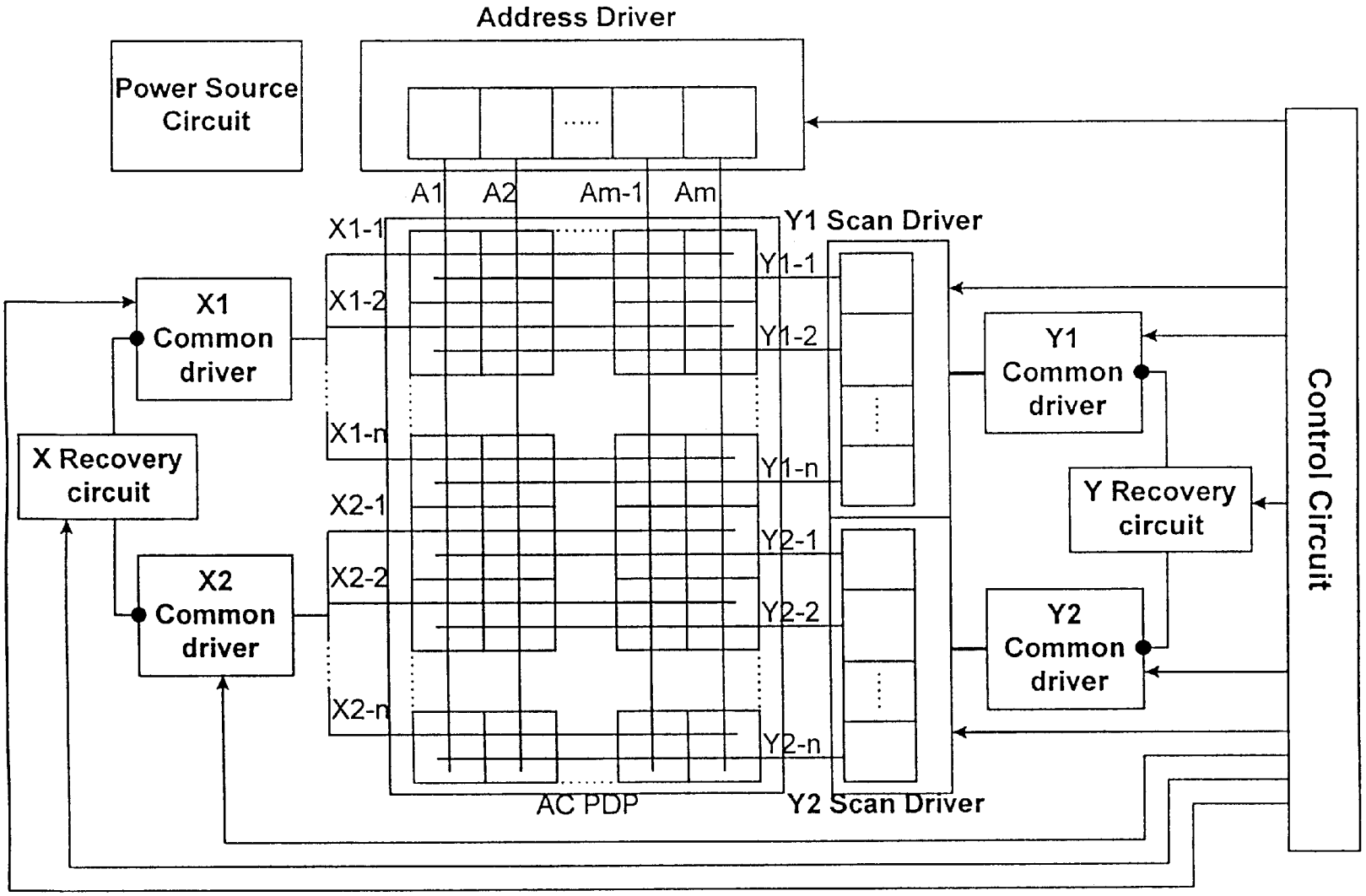
FIG. 9 is a schematic diagram of an energy recovery driver circuit for a tri-electrode planar discharge AC-PDP having the energy recovery parts according to the present invention.

FIG. 9 is a schematic diagram of a driver circuit for a tri-electrode planar discharge AC-PDP utilizing the energy recovery parts according to the present invention.

When all of the X electrodes in an AC-PDP are driven by two or more common X electrode driver circuits, the conventional methods require a separate energy recovery part for each of the common X electrode driver circuits or just one common energy recovery part.

The individual common X electrode driver circuits and their corresponding energy recovery parts are all commonly connected to the X electrodes via a connection part and all the loads are approximated to a capacitor, when seen from the energy recovery part.

In the energy recovery driver circuit according to the present invention, as illustrated in FIG. 9, the individual common X electrode driver circuits are connected together through the energy recovery part. Also, two or more common X electrode driver circuits can be connected with each other through an energy recovery part. Therefore, the common X electrode driver circuits share a energy recovery part, thereby simplifying the connection between the common X electrode driver circuits and the energy recovery part.

The connection between the common Y electrode driver circuits may be similar to that of the common X electrode driver circuits, but the necessity of the scan drivers may make the connection slightly different.

The following is an explanation of the effects of the AC-PDP energy recovery driver circuit of the present invention in comparison with those of the Weber and Sakai methods with emphasis on their input voltage rise time periods required for the stable control of the panel sustain voltage levels and their energy recovery efficiencies.

During the operation of an AC-PDP energy recovery driver circuit, the paths of the current form a loop. If the driver circuit is simplified according to the paths, it is noted that all the driver circuits utilize the inductance-capacitance (LC) series resonance circuits. Therefore, such AC-PDP energy recovery driver circuits should have a 100% energy recovery efficiency in ideal cases, but in reality the resistances therein pull down the recovery efficiency. Moreover, the energy recovery efficiency is curtailed by various noise elements, voltage drops and resistance components across the power MOSFETs and diodes used as switches located along the current paths, the existence of the reverse recovery time ("trr") in the diodes, changes of the capacitance in the power MOSFETs during the off-state in response to the input voltages and the parasitic capacitances formed within the circuit. As the above factors, however, affect a little against the energy recovery efficiency, only the total resistance value along the current paths will be taken into account for the following explanation. Thus, the comparison of the voltage variations in the electrodes influenced by the current flows, using such simplified model, is given below with reference to FIGS. 10*a*~10*c*.

Figure 1:
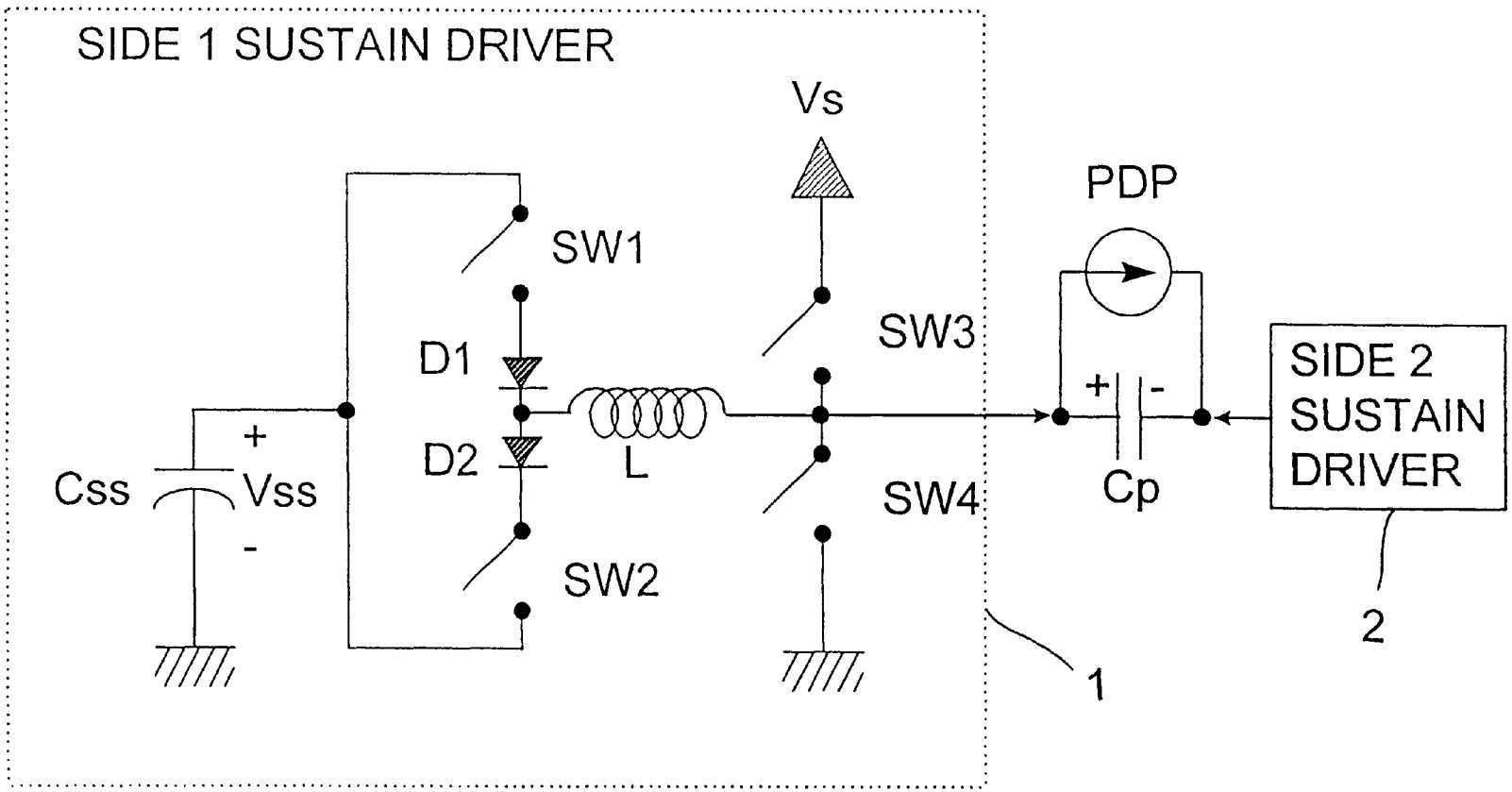
FIG.1 (PRIOR ART)
FIG. 1 is a schematic diagram of an energy recovery driver circuit according to the Weber method.
Figure 10A:
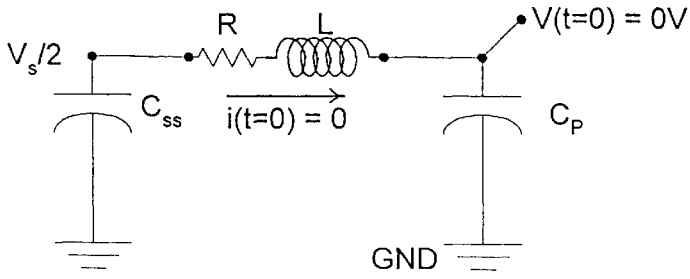
FIGS. 10*a*, 10*b* and 10*c* are the modeling diagrams of the energy recovery driver circuits according to the prior arts and the present invention.

FIG. 10*a* is a modeling diagram of an energy recovery driver circuit according to the Weber method shown in FIG. 1. Referring to FIG. 1, during the time period when the electrode voltage level rises, the path of the current is formed along the ground GND, the capacitor Css, the switch SW1, the diode D1, the inductor L, the capacitor Cp and the switch SW4 of the side 2 sustain driver and the ground GND. If the parts except the capacitor Css (this is approximated to a constant voltage source), the inductor L and the capacitor Cp are approximated to a resistance, the current path circuit is represented as shown in FIG. 10*a*.

If the Laplace transform is applied to the circuit shown in FIG. 10*a*, the voltage equation in s-domain will be as follows:

$$V_{(s)} = \frac{\frac{1}{LC}}{s^{2+}\left(\frac{R}{L}\right)s + \left(\frac{1}{LC}\right)} \tag{1}$$

Figure 2:
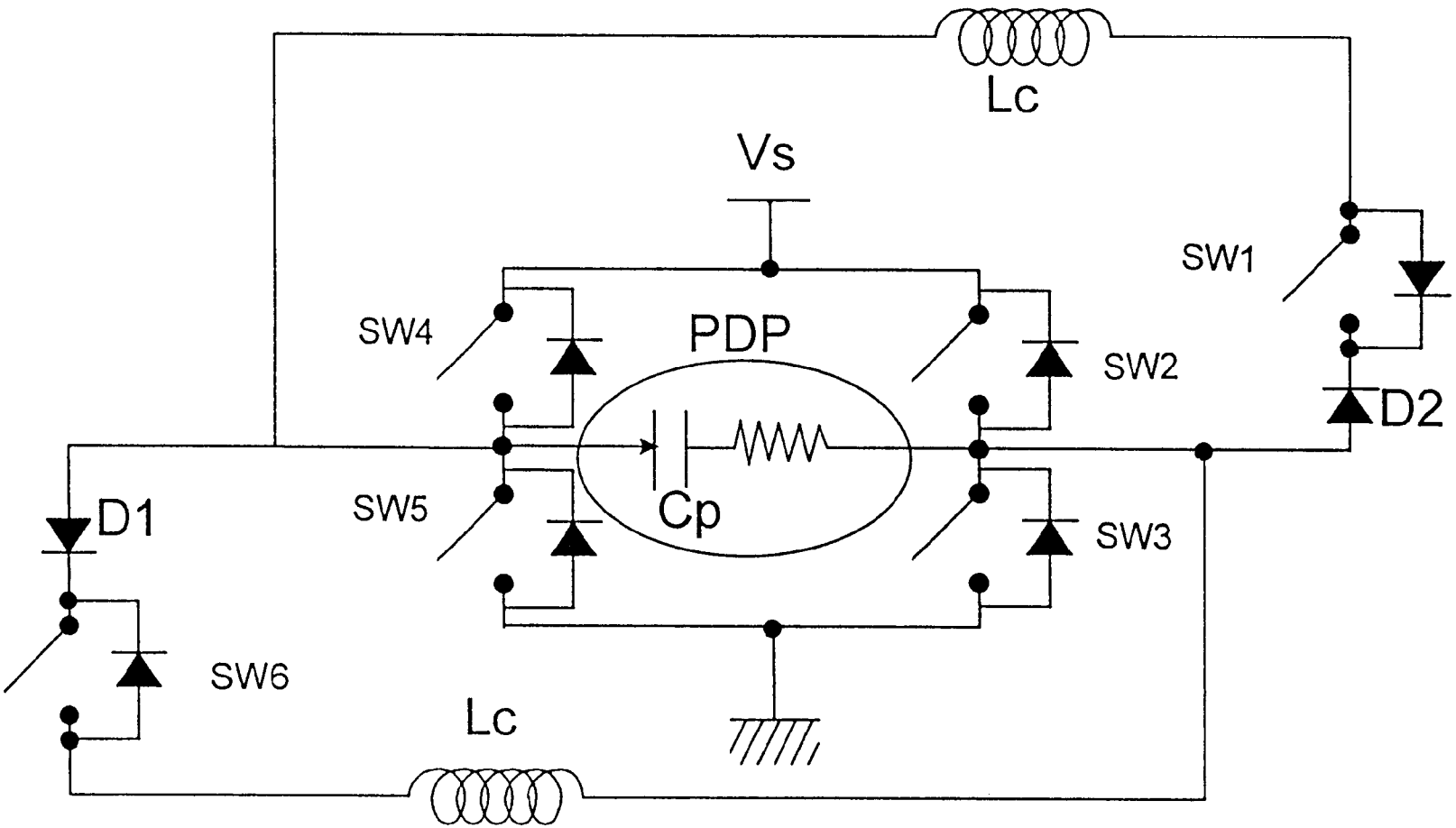
FIG.2 (PRIOR ART)
FIG. 2 is a schematic diagram of an energy recovery driver circuit according to the Sakai method.
Figure 3:
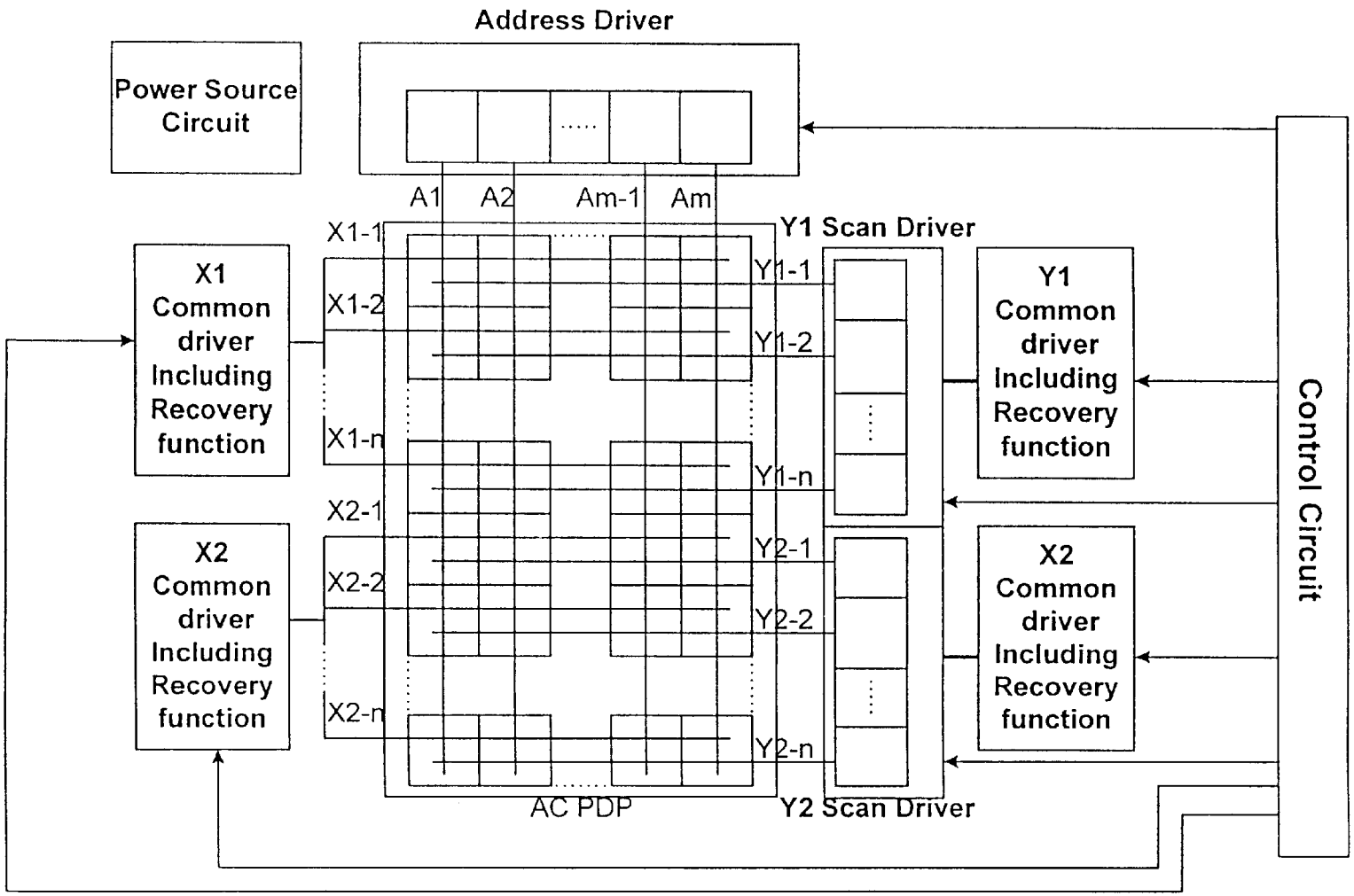
FIG.3 (PRIOR ART)
FIG. 3 is a schematic diagram of a driver circuit for a tri-electrode planar discharge AC-PDP with the Weber type energy recovery part.
Figure 10B:
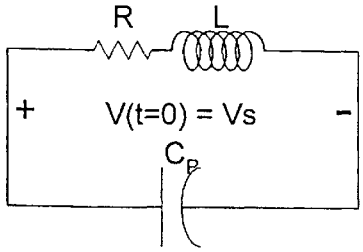

FIG. 10*b* is a modeling diagram of an energy recovery driver circuit according to the Sakai method shown in FIG. 2. Referring to FIG. 2, during the time period when the electrode voltage reverses, the current path is formed along the capacitor Cp, the diode D1, the switch SW5 and the inductor Lc.

The current path may be approximated to the circuit illustrated in FIG. 10*b*. If the Laplace transform is applied to this circuit, the voltage equation in the s-domain will be as follows:

$$V_{(s)} = \frac{Vs}{s} - \frac{\frac{1}{LC}}{s^2 + \left(\frac{R}{L}\right)^2 + \left(\frac{1}{LC}\right)} \cdot \frac{Vs}{s} \tag{2}$$

Figure 10C:
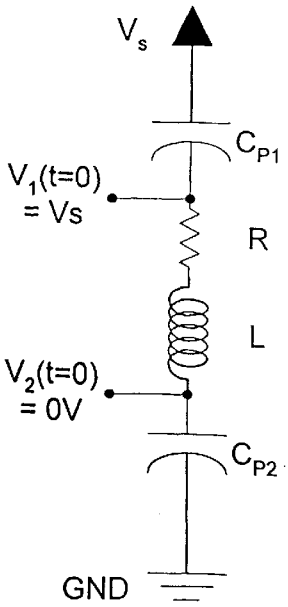

FIG. 10*c* is a modeling diagram of an energy recovery driver circuit according to the present invention shown in FIG. 4. When the X1 electrode voltage level rises and the X2 electrode voltage level falls, the current path is formed along the positive terminal of the capacitor Cs, the switch SW7 the capacitor Cp1, the inductor L2, the diode D6, the switch SW6, the capacitor Cp2, the switch SW10 and the negative terminal of the capacitor Cs (or the ground GND).

If the Laplace transform is applied to this circuit, the voltage equation in the s-domain will be as follows:

$$V_{2(s)} = \frac{\frac{2}{LC}}{S^2 + \left(\frac{R}{L}\right)^2 + \left(\frac{2}{LC}\right)} \times \frac{Vs}{2s} \tag{3}$$

The voltage levels for the equations (1) and (3) have a range of 0V to Vs, whereas the voltage level for the equation (2) ranges from Vs to −Vs. However, the time-dependent characteristics of the equations (1) and (2) are the same.

However, the constant term of the denominator in the equation (3) is 2/LC, whereas it is 1/LC for equations (1) and (2). These differences affect the manner in which the voltage level changes in the time domain as shown in the table 1.

TABLE 1

Essential factors for the approximated energy recovery driver circuits

| | Conventional Methods | Present Invention |
|---|---|---|
| natural frequency | $\omega_n = \sqrt{\frac{1}{LC}}$ | $\omega_n = \sqrt{\frac{2}{LC}}$ |
| damping ratio | $\zeta = \frac{R}{2}\sqrt{\frac{C}{L}}$ | $\zeta = \frac{R}{2\sqrt{2}}\sqrt{\frac{C}{L}}$ |
| rise time | $T_r = \frac{\pi}{\omega_n\sqrt{1-\zeta^2}} \cong \pi\sqrt{LC}$ | $T_r = \frac{\pi}{\omega_n\sqrt{1-\zeta^2}} \cong \pi\sqrt{\frac{LC}{2}}$ |
| peak voltage | $V_{peak} = \frac{V_s}{2}\cdot\left(1 + e^{-\left(\zeta\pi/\sqrt{1-\zeta^2}\right)}\right)$ | |

The effects of the above factors on the wave forms of voltage in time domain will be explained below.

The natural frequency is the prime factor in determining the voltage rise time, since the driver circuits depend on the inductance-capacitance resonance in their operations. In practice, since the damping ratios generally have values of less than 0.1, it can be said that the voltage level rise time is mostly in inverse proportion to the natural frequency.

Though the voltage levels of the modeling circuit show the resonance characteristics when the voltage levels fall after the rise for a certain time of periods, the current in original driver circuits, as opposed to the approximated modeling circuits, just flow once because the diodes along the current path block the inversed currents from flowing at the peak voltage. Therefore, the actual voltage recovery efficiency directly relate to the peak voltages in the table 1. Since the exponential term of the peak voltage equation is approximately inversely proportional to the damping ratio, the increase of the damping ratio means that the peak voltage falls almost in a linear manner.

As shown in the table 1, the damping ratio and the voltage level rising time of the present invention, which directly affect the recoverable peak voltage $V_{peak}$, differ from those of the conventional methods. This means that if the energy recovery circuit of the present invention is designed to have the same voltage rising time period with the same sustain voltage as in the conventional methods and the sum of the resistances along the current paths is the same as those in the conventional methods, its inductance will become twice bigger and the damping ratio will be a half in comparison with those of the conventional methods, thereby enhancing the energy recovery efficiency. More specifically, the energy recovery efficiency increases from 90% to approximately 95%.

However, the above operation analysis of the modeling circuits by using the above equations render some problems. First, the modeling circuits are useful for analyzing the momentary or instantaneous operation of a driver circuit at a particular electrode during a time period when the exact electrode's voltage level keeps rising and there are so much variation in the sum of the resistance value in the path of the currents, when the circuit elements related to the energy recovery operation of the original driver circuits per a cycle of the input electrode voltage.

Second, the actual energy recovery driver circuits utilizing those methods will differ with each other in the total resistance and other factors. Therefore, when the total energy consumptions during a certain period are to be calculated, the method for calculating the energy recovery efficiency of the present invention differ from those other methods.

The analysis of those actual driver circuits involves various variables and this makes the analysis of the actual energy recovery circuits extremely difficult. For convenience' sake, in the analysis of the actual energy recovery circuits, only the factors which necessarily curtails the energy recovery efficiency will be taken into account. More specifically, only the turn-on resistances in the switches and the voltage drops across only the diodes except other semiconductor elements will be considered.

Before calculating the energy recovery efficiencies, explanations regarding some values are given in the table 2 for convenience' sake.

TABLE 2

| | |
|---|---|
| Switches | It is assumed that all the switches have the same value of the turn-on resistances $R_{DS\text{-}ON}$ ("Ron"), the currents that flow across the drains and sources of the switches are proportional to the voltage across the switch terminals. |
| Diodes | Since the resistance is not taken into account, as its is only 1/10 of that of the switch and only 1 volt of the voltage drop is deemed to exist. |
| Voltage after energy recovery operation | Voltages for the Weber method, the Sakai method and the present invention are designated as Vr1, Vr2, and Vr3x and Vr3y respectively. |
| Capacitors | Cp1 = Cp2 = Cp |

First, the power consumption efficiency of the Weber method energy recovery driver circuit is analyzed.

The voltage level at each of the X1, X2, X3 and X4 electrodes rises and falls just once per a cycle. When the voltage level rises, the total resistance does not change for each of the individual electrode driver circuits and the resistance components of the MOSFET switches which necessarily contribute to the total resistance, as clear from FIG. 1, are the turn-on resistance Ron of the switch SW4 of the side 2 sustain driver and the switch SW1. Moreover, since a diode is involved, the resistance of 2×Ron will exist.

The situation is the same when the voltage level falls. In practice, however, as a diode is connected in parallel with the switch SW4 of the side 2 sustain discharge driver in FIG. 1, only one resistor of Ron exists, but the voltage drops occur twice due to the diodes.

Therefore, though the voltage Vss across the capacitor Css is regulated to a half of the Vs, the exact value of the voltage Vss is slightly higher than ½×Vs.

At this moment, the energy recovery efficiency slightly increases compared to that of the moment when the voltage Vss equals the voltage ½×Vs. Therefore, the total energy consumption at the four electrode driver circuits during a complete cycle is:

$$P_1 = 4Cp(Vs - Vr_1)Vs \tag{4}$$

In the analysis of the Sakai method energy recovery driver circuit, differences in the resistance value have to be taken into account. Since the phases of the voltages at the X1 and Y1 electrodes are complementary with each other, the energy recovery operation period during the voltage level rising period at the X electrodes and voltage level falling period at the Y electrodes makes the same operating condition as the period of the Y electrode voltage rising and the X electrode voltage falling. In this method, only one resistance of Ron and one diode voltage group exist along the current path. Therefore, its theoretical efficiency is better than that of the Weber method. However, the actual energy consumption at the four electrode driver circuits during a complete cycle is given:

$$P_2=4Cp(Vs-Vr_2)Vs \quad (5)$$

For the energy recovery driver circuit according to the present invention, two energy recovery situations exist and this renders analysis more difficult.

The first energy recovery situation, when the currents are exchanged between the X electrodes, is as follows: When the X2 electrode voltages are falling and the X1 electrode voltage levels are rising or when the X2 electrode voltage levels are falling, three resistors of Rons exist along the current paths and one voltage drop across a diode arises.

Therefore, the resistance will curtail the energy recovery efficiency. More specifically, the current flows out of the capacitor Cs in the power supply part through the current path and into the ground GND, thereby consuming the energy of $Cp\times Vr_3x\times Vs$, when seen in the view of the, power supply part. This energy consumption is a unique aspect of the present invention, because the energy recovery operations in the conventional methods have nothing to do with the power supply part. However, this energy consumption is completely compensated in the second energy recovery situation, when the currents are exchanged between the Y electrodes. When the Y2 electrode voltage levels are falling and the Y1 electrode voltage levels are rising, or when the Y1 electrode voltage levels are falling and the Y2 electrode voltage levels are rising, one resistor of Ron exists along the current path and the three voltage drops across the diodes arise.

Since the one resistor of Ron which greatly affects the energy recovery efficiency is smaller number when compared with X electrode case, the energy recovery efficiency can be enhanced. Also, the current in this situation starts from the ground GND and flows towards the positive terminal of the capacitor Cs.

Therefore, the energy charged in the power supply part is equal to $Cp\times Vr_3y\times Vs$ (the voltage is assumed to be constant because the capacitor Cs is sufficiently large). This charged energy is larger than the energy consumed during the exchange of the currents between the X electrodes ($Vr_3y>Vr_3x$), thereby increasing the energy recovery efficiency. Thus, the total power consumption per a cycle is given:

$$P_3=2Cp(Vs-Vr_3x)Vs+2Cp(Vs-Vr_3y)Vs-2CpVr_3yVs+2CpVr_3xVs=4CpVs(Vs-Vr_3y) \quad (6)$$

The following table 3 shows a summary of the power consumptions in the methods described above.

TABLE 3

| Methods | Total energy consumption per one cycle | Remarks | |
|---|---|---|---|
| | | Ron | Diodes |
| No power recovery | $P_0 = 4CpV^2s$ | — | — |
| Weber | $P_1 = 4Cp(Vs-Vr_1)Vs$ | 2/1 | 1/2 |
| Sakai | $P_2 = 4Cp(Vs-Vr_2)Vs$ | 1/1 | 1/1 |
| Present invention | $P_3 = 4Cp(Vs-Vr_3y)Vs$ | 3/1 | 1/3 |

Since the number of the resistor of Ron and the diodes in the Sakai method is fewer than the other methods, one may be liable to conclude that the Sakai method is most efficient. However, since the peak level $Vr_3y$ of the present invention is attained with the existence of the only one resistance Ron, the total resistance becomes close to that of the Sakai method, when the value $Vr_3y$ is put into the equation in the table 1. Moreover, since the damping ratio of the present invention corresponding to a voltage rise time is half of those of the conventional methods, ultimately the present invention will have a better efficiency.

Moreover, since the voltage level rising time and the voltage level falling time of the conventional methods are the same and the energy recovery circuit has to be designed in accordance with the voltage rising time which is directly related with the sustain discharge in the AC-PDP, it is hardly possible to improve the recovery efficiency during the voltage level falling period. In contrast, the energy recovery driver circuit of the present invention can make it easier to improve the energy recovery efficiency by making the inductance values for the inductors L3 and L4 in FIG. 4 even with a longer period of time for the energy recovery, since the energy recovery circuit for the X electrodes is designed in accordance with the sustain discharge of the AC-PDP and the energy recovery circuit of the Y electrode has a relatively small effect.

Therefore, the difference between the voltages after energy recovery operation values $Vr_3y$ and $Vr_2$ in the equations of the table 3 becomes substantially large. These factors may bring a 30% decrease in the power consumption in the aspect of comparing the power consumptions other than the energy recovery efficiency comparison aspect. Moreover, the less the time is required for creating a potential difference between the X and Y electrodes, i.e., the voltage level rising time, is reduced, the bigger the difference in the energy recovery efficiencies between the present invention and the other methods becomes. These good aspects of the energy recovery circuit of the present invention are all from the effect of reducing the load of energy recovery circuit down to a half of its original value. And this reducement of load is due to the arrangement of two (2) loads in series. Thus, it can be said that the view in solving the energy recovery problem has changed from considering just one (1) load to considering two (2) loads simultaneously.

As the forgoing preferred embodiments of the present invention have been described and shown as examples only, it is understood that alternatives and modifications, such as those suggested and others, may be made thereto and fall within the scope of the invention.

What is claimed is:

1. A driving circuit for AC PDPs comprising sustain electrodes which are divided into at least two groups X ($x_1$, $x_2$, $x_3$ . . . $x_n$) and Y ($y_1$, $y_2$, $y_3$ . . . $y_n$) according to the locations of their respective voltage input terminals and provided with a capacitance between every two opposing electrodes (e.g., $x_1$ and $y_1$), wherein said X group and Y group electrodes form two subgroups $X_1$ and $X_2$, and $Y_1$ and $Y_2$ with the same or different number of electrodes, which have the corresponding drive circuits and two different levels of driving voltages $V_1$ and $V_2$ (where $V_1>V_2$) are applied to said capacitance so that the potential differences therebetween may cause to make plasma discharging in the corresponding sub-pixels;

further comprising a first and a second sustain drivers which are respectively connected to voltage input terminals for the subgroups $X_1$ and $X_2$ of said sustain electrodes, and a first and a second scan drivers which are respectively connected to the voltage input terminals for the subgroups $Y_1$ and $Y_2$ of said sustain electrodes, and a third and a fourth sustain drivers which are respectively connected to said first and second scan drivers, wherein two energy recovery circuits having one or two inductors and a plurality of switch elements are respectively connected between said first and second sustain drivers and between said third and fourth sustain drivers.

2. A driving circuit for AC PDPs comprising sustain electrodes which are divided into at least two groups X ($x_1$, $x_2$, $x_3$ . . . $x_n$) and Y ($y_1$, $y_2$, $y_3$ . . . $y_n$) according to the locations of their respective voltage input terminals and provided with a capacitance between every two opposing electrodes (e.g., $x_1$ and $y_1$) wherein said X group and Y group electrodes form two subgroups $X_1$ and $X_2$, and $Y_1$ and $Y_2$ with the same or different number of those electrodes, which have the corresponding drive circuits and two different levels of driving voltages $V_1$ and $V_2$ (where $V_1>V_2$) are applied to said capacitances so that the potential difference therebetween may cause to make plasma discharging in the corresponding sub-pixels, further comprising a first energy recovery circuit having one or two inductors and a plurality of switch elements connecting between the subgroups $X_1$ and $X_2$ of said sustain electrodes; a second energy recovery circuit having one or two inductors and plurality of switch elements connecting between the subgroups $Y_1$ and $Y_2$ of said sustain electrodes; and a driving circuit for the subgroups $X_1$ and $X_2$ of said sustain electrodes comprises at least a diode or the equivalent which allows electric current to flow from the voltage input terminals for said sustain electrodes to the source of the driving voltage $V_1$ and at least a diode or the equivalent which allows electric current to flow from the source of the driving voltage $V_2$ to the voltage input terminals for said sustain electrodes either or both of the subgroups $X_1$ and $X_2$.

3. A driving circuit for AC PDPs comprising sustain electrodes which are divided into at least two groups X ($x_1$, $x_2$, $x_3$ . . . $x_n$) and Y ($y_1$, $y_2$, $y_3$ . . . $y_n$) according to the locations of their respective voltage input terminals and provided with a capacitance between every two opposing electrodes (e.g., $x_1$ and $y_1$), wherein said X group and Y group electrodes form two subgroups $X_1$ and $X_2$, and $Y_1$ and $Y_2$ with the same or different number of electrodes, which have the corresponding drive circuits and two different levels of driving voltages $V_1$ and $V_2$ (where $V_1>V_2$) are applied to said capacitances so that the potential differences therebetween may cause to make plasma discharging in the corresponding sub-pixels;

further comprising a first resonance circuit having an inductor and a plurality of switch elements connecting between the subgroups $X_1$ and $X_2$, of said sustain electrodes in addition to said capacitances between every pair of said sustain electrodes in the subgroups $X_1$ and $Y_1$, and $X_2$ and $Y_2$;

a second resonance circuit having an inductor and a plurality of switch elements connecting between the subgroups $Y_1$ and $Y_2$ of said certain electrodes in addition to said capacitances between every pair of said sustain electrodes in the subgroups $X_1$ and $Y_1$, and $X_2$ and $Y_2$; and a driving circuit for said sustain electrodes in the subgroups $X_1$ and $X_2$ comprises at least a diode or the equivalent which allows electric current to flow from the voltage input terminals for said sustain electrodes to the source of the driving voltage $V_1$ and at least a diode of the equivalent which allow electric current to flow from the source of the driving voltage $V_2$ to the voltage input terminals for said sustain electrodes.

4. A method for driving AC PDPs comprising sustain electrodes which are divided into at least two groups X ($x_1$, $x_2$, $x_3$ . . . $x_n$) and Y ($y_1$, $y_2$, $y_3$ . . . $y_n$) according to the locations of their respective voltage input terminals and provided with a capacitance between every two opposing electrodes (e.g., $x_1$ and $y_1$), wherein said X group and Y group electrodes form two subgroups $X_1$ and $X_2$, and $Y_1$ and $Y_2$ with the same or different number of electrodes, which have the corresponding drive circuits and two different levels of driving voltages $V_1$ and $V_2$ (where $V_1>V_2$) are applied to said capacities so that the potential differences therebetween may cause to make plasma discharging in the corresponding sub-pixels; said AC PDPs further comprising a first resonance circuit having an inductor and a plurality of switch elements connecting between said sustain electrodes in the subgroups $X_1$ and $X_2$, in addition to said capacitances between every pair of said sustain electrodes in the subgroups $X_1$ and $Y_1$, and $X_2$ and $Y_2$;

a second resonance circuit having an inductor and a plurality of switch elements connecting between said sustain electrodes the subgroups $Y_1$ and $Y_2$ in addition to said capacitances between every pair of said sustain electrodes in the subgroups $X_1$ and $Y_1$, and $X_2$ and $Y_2$;

a driving circuit for said sustain electrodes in the subgroup $X_1$ comprises at least a diode or the equivalent which allows electric current to flow from the voltage input terminals for said sustain electrodes to the source of the driving voltage $V_1$ and at least a diode or the equivalent which allows electric current to flow from the source of the driving voltage $V_2$ to the voltage input terminals for said sustain electrodes; and a driving circuit for said sustain electrodes in the subgroup $X_2$ comprises at least a diode or the equivalent which allows electric current to flow from the voltage input terminals for said sustain electrodes to the source of the driving voltage $V_1$ and at least a diode or the equivalent which makes electric current to flow from the source of the driving voltage $V_2$ to the voltage input terminals for said sustain electrodes;

said method comprising the steps of:

said first resonance circuit changes voltages at said sustain electrodes in the subgroups $X_1$ and $Y_2$, $X_2$ and $Y_1$ to $V_1$, $V_2$ respectively from the initial state that voltages at said sustain electrodes in the subgroups $X_1$ and $Y_1$, $X_2$ and $Y_2$ are $V_2$, $V_1$ respectively;

that said second resonance circuit subsequently changes voltages at said sustain electrodes $X_1$ and $Y_1$, $X_2$ and $Y_2$ to $V_1$, $V_2$ respectively;

that said second resonance circuit subsequently changes voltages at said sustain electrodes $X_2$ and $Y_1$, $X_1$ and $Y_2$ to $V_1$, $V_2$ respectively; and that said second resonance circuit in turn changes voltages at said sustain electrodes $X_1$ and $Y_1$, $X_2$ and $Y_2$ to $V_1$, $V_2$ respectively, returning the voltage levels to those in the initial state for the continuous driving operation, wherein electric current flows from the power supply for the voltage $V_2$ to the power supply for the voltage $V_1$ in the above steps in which said second resonance circuit changes voltage levels at said sustain electrodes $X_1$, $X_2$, $Y_1$ and $Y_2$.

5. A method as claimed in claim 4, wherein the voltages $V_1$ and $V_2$ are the power supply voltage and ground voltage respectively.

6. A method as claimed in claim 4, wherein said sustain electrodes in the subgroups $X_1$, $X_2$,, $Y_1$ and $Y_2$ are respectively divided into 2n(where n is a natural number) sub-subgroups with the same or different number of those electrodes and said sustain electrodes in every other two adjacent sub-subgroups are connected to one among 2n series resonance circuits.

* * * * *